United States Patent [19]

Chesnut

[11] Patent Number: 4,719,851

[45] Date of Patent: Jan. 19, 1988

[54] METHOD AND APPARATUS FOR INDICATING NEED FOR REPLACEMENT OF TRASH-TREATING MATERIAL SUPPLY

[75] Inventor: Paul B. Chesnut, Armstrong Township, Vanderburg County, Ind.

[73] Assignee: Whirlpool Corporation, Benton Harbor, Mich.

[21] Appl. No.: 945,898

[22] Filed: Dec. 24, 1986

[51] Int. Cl.[4] ..... B30B 15/08

[52] U.S. Cl. ..... 100/45; 100/35; 100/73; 100/99; 100/229 A; 222/646; 222/649; 422/5

[58] Field of Search ..... 100/45, 229 A, 99, 73, 100/299, 35; 222/646, 649; 62/234; 422/5; 312/211, 31.3

[56] References Cited

U.S. PATENT DOCUMENTS

| | | | |
|---|---|---|---|
| 2,251,058 | 7/1941 | Kirkman | 422/5 |
| 3,800,694 | 4/1974 | Miller et al. | 100/45 |
| 3,837,532 | 9/1974 | Sahatjian et al. | 222/649 |
| 3,839,952 | 10/1974 | McDonald et al. | 100/45 |
| 3,890,798 | 6/1975 | Fujimoto et al. | 62/234 X |
| 3,901,139 | 8/1975 | Moriconi | 100/99 |
| 3,918,360 | 11/1975 | Stratman et al. | 100/73 X |
| 3,920,154 | 11/1975 | Sugawara | 222/23 |
| 3,938,433 | 2/1976 | Borum | 100/51 |
| 4,047,775 | 9/1977 | Wolbrink | 312/211 |
| 4,063,664 | 12/1977 | Meetze, Jr. | 222/70 |
| 4,068,575 | 1/1978 | Difley et al. | 100/45 |
| 4,147,100 | 4/1979 | Dykstra | 100/48 |

*Primary Examiner*—Andrew M. Falik

*Attorney, Agent, or Firm*—Wood, Dalton, Phillips, Mason & Rowe

[57] ABSTRACT

An indicator for use in a refuse compactor for effectively indicating the need for replacement of a refuse-treating material supply as a function of the normal depletion thereof. The indicator is controlled by a timer accumulating incremental time during each operation of the compaction ram and operates a signaling indicator when the accumulated time reaches a preselected value. The indicator may be used with any form of refuse-treating material apparatus. In the illustrated embodiment, the refuse-treating material apparatus is an aerosol spray can of deodorizing and sanitizing material removably mounted within the refuse compactor cabinet.

14 Claims, 2 Drawing Figures

METHOD AND APPARATUS FOR INDICATING NEED FOR REPLACEMENT OF TRASH-TREATING MATERIAL SUPPLY

TECHNICAL FIELD

This invention relates to refuse compactors and in particular to indicating means for use in the operation of refuse compactors.

BACKGROUND ART

In one well-known form of refuse compactor, refuse is deposited in a drawer. A compacting ram is actuated to move downwardly into the drawer, compact the refuse therein, and return to a retracted position in an automatic compaction cycle. Resultingly, a substantial amount of refuse may be collected in the drawer before transfer thereof to a disposal means, such as an outdoor garbage can or the like.

The collection of the refuse may take place over an extended time, and it has been found desirable to provide a sanitizing spray on the deposited refuse to reduce odor and maintain sanitary conditions. A number of devices for spraying such treating material onto the refuse has been developed, examples thereof being illustrated in U.S. Pat. Nos. 3,800,694 of Frank E. Miller et al.; 3,839,952 of William Roy McDonald et al; and 4,068,575 of Charles R. Difley et al. As disclosed therein, the disinfecting and deodorizing material may be provided in the form of an aerosol spray from a supply comprising a can of the material removably mounted in the refuse compactor and arranged to be operated as a result of movement of the drawer.

Conventionally, cam means are provided on the drawer for engaging actuating means associated with the aerosol spray dispenser to effect the desired delivery of the treating material onto the deposited refuse.

In another form of refuse-treating means, a solid form of treating means is incrementally dispensed onto the deposited refuse.

SUMMARY OF INVENTION

The present invention comprehends an improved refuse compactor structure having means for signaling or indicating to the user the need for replacement of the supply of refuse-treating material.

It has been found that there is a sufficient correlation in the normal use of such refuse compactors between the number of times the compacting ram is caused to effect a compaction of refuse in the refuse compactor, with the amount of treating material delivered from the supply.

The present invention comprehends the provision of means in such a refuse compactor of indicating the need for replacement of the refuse-treating material supply as a function of the number of operations of the compacting means.

More specifically, the invention comprehends the use of timer means accumulating incremental time corresponding to each compaction operation of the refuse compactor and effecting the operation of a signaling or indicating device upon the accumulation of a preselected total time.

Thus, more specifically, the invention comprehends a method of indicating the need for replenishing a supply of trash-treating material sequentially delivered into a trash compactor trash receiver, including the steps of causing a timer to advance seriatim a preselected amount as a result of each compacting operation of the ram of the trash compactor, and causing an indication of the need to replenish the material supply as a result of the preselected cumulative advance of the timer.

In the illustrated embodiment, the supply of trash-treating material comprises an aerosol can of spray material.

In the illustrated embodiment, the control for controlling operation of the ram includes a top limit switch, operation of which effects the incremental running of the timer.

The method and apparatus of the invention is extremely simple and economical of construction, while yet providing the improved indication for the need of material treatment supply replenishment in such refuse compactors.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figure 1:
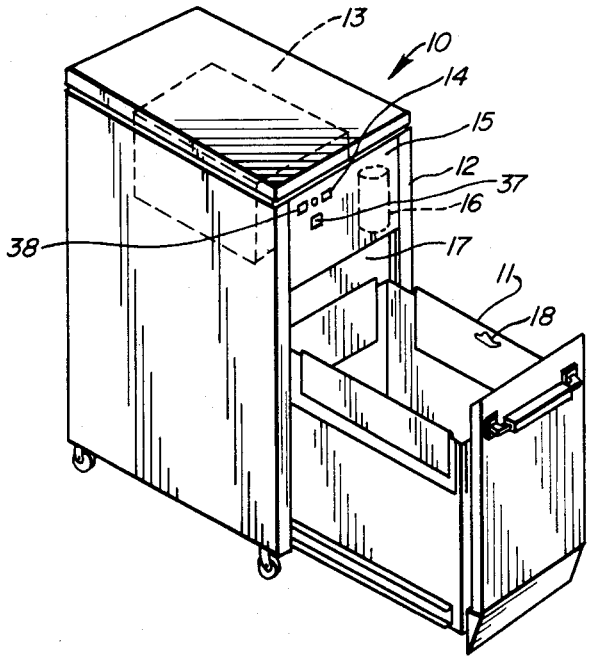
FIG. 1 is a perspective view of a refuse compactor embodying the invention.

In the illustrative embodiment of the invention as disclosed in the drawing, a refuse compactor generally designated 10 is shown to comprise a domestic-type refuse compactor having a drawer 11 in which refuse to be compacted is deposited when the drawer is drawn forwardly from a cabinet 12 of the compactor to an access position, as illustrated in FIG. 1.

The refuse compactor includes a ram 13 which is caused to move downwardly into the drawer 11 when the drawer is returned to the compacting position fully within cabinet 12. Suitable manual control buttons 14 are provided on the front wall 15 of the cabinet to permit the user to effect compaction of the deposited trash by initiating a compaction cycle wherein the ram automatically compacts the trash in the drawer 11 and returns to a retracted position superjacent the drawer space, as shown in broken lines in FIG. 1.

As discussed briefly above, it is desirable to provide deodorizing and sanitizing treating material onto the deposited trash in such refuse compactors. As further shown in FIG. 1, an aerosol spray container 16, containing a supply of such refuse-treating material, is mounted within the cabinet 12 superjacent the drawer-receiving space 17 for spraying the deposited refuse as the drawer is moved from the access position of FIG. 1 to the compaction position within space 17. Illustratively, operation of the spray device 16 may be effected by a suitable cam 18 mounted to the drawer. As will be obvious to those skilled in the art, any suitable means for effecting delivery of the spray material from the supply onto the deposited refuse may be utilized within the broad scope of the invention.

The present invention is concerned with the problem of indicating to the user the need for replenishing the supply of such refuse-treating material. In the absence of such an indicating means, it has been found that the user may not be apprised of the need for such replenishment and undesirably carry out continuing use of the compactor without realizing that the supply has been depleted until such time as the user notices the development of odors or unsanitary conditions in the compacted refuse.

The invention comprehends the provision of a signal for indicating the need for replenishment of the treating material supply as a function of the number of cycles of operation of the compacting ram. It has been found that the determination of the need for replacement of the supply is sufficiently correlated with the number of cycles of operation following the placement of the supply in the refuse compactor to permit effective signaling in this manner.

Figure 2:
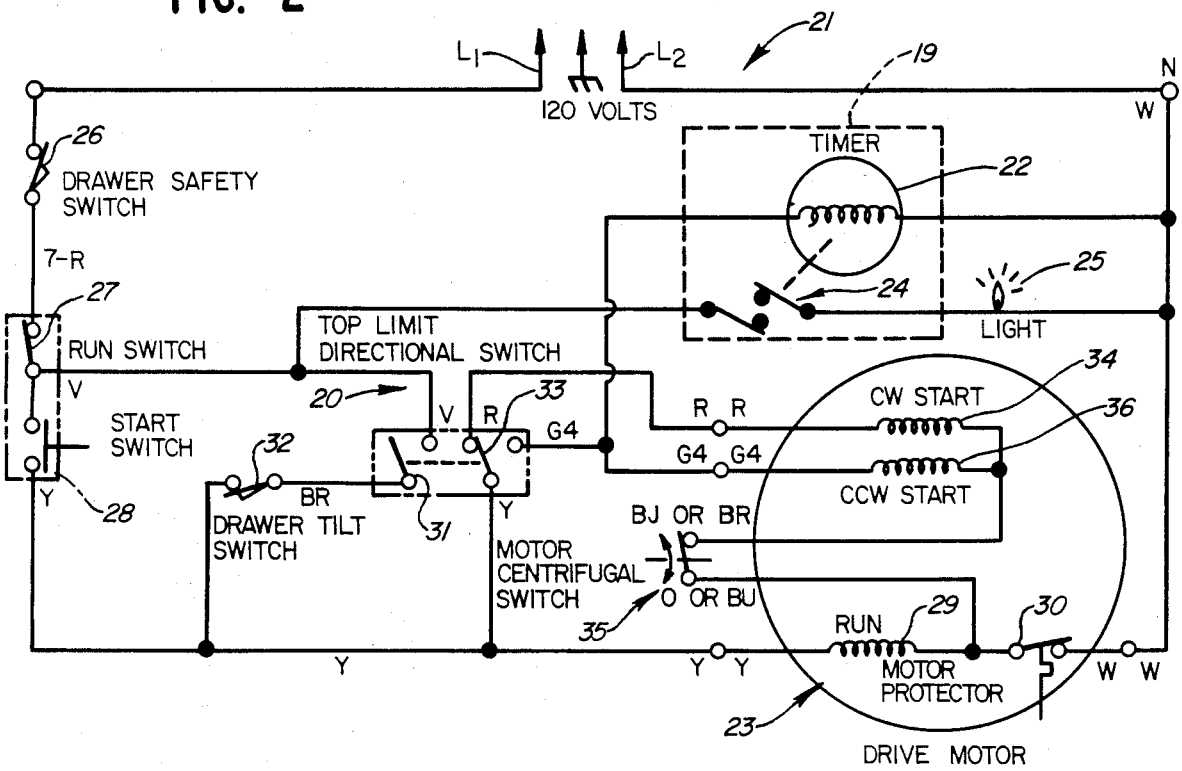
FIG. 2 is a schematic electrical diagram illustrating control circuitry of the invention.

More specifically, the invention comprehends the provision of a timer generally designated 19 which is incrementally run to accumulate time as a function of the closing of the top limit-directional switch of the refuse compactor control generally designated 21 illustrated in FIG. 2.

As illustrated in FIG. 2, the timer includes a timer motor 22, which is energized during the operation of the ram drive motor generally designated 23. The incremental running of the timer motor is accumulated and, upon the timer reaching a preselected cumulative time, the timer causes a closing of a normally open timer switch 24 connected in series with an indicating lamp 25 for illuminating a translucent indicator 37 on the front wall 15 of cabinet 12.

Lamp 25 is connected to provide a constant indication to the user of the possible need for replacement of the refuse-treating material supply. The control may include a reset button 38 for resetting the timer at the time the treating material supply is replaced. As will be obvious to those skilled in the art, a suitable control may be associated with the means for mounting the spray container so as to effect an automatic resetting of the timer by such replacement.

As will be further obvious to those skilled in the art, the timer may comprise a digital counter-type timer having means for indicating the number of operations of the apparatus to provide further information as to the status of the refuse-treating material supply.

As further illustrated in FIG. 2, the control 21 includes a drawer safety switch 26, a run switch 27, and a start switch 28 connected in series from power supply lead L1 through the run winding 29 of motor 23 and motor protector 30 thereof to the opposite power supply lead L2.

A first set of normally open contacts 31 of top limit switch 20 is connected through a drawer tilt switch 32 to provide a holding circuit around the start switch 28 after initial downward movement of the ram, to break a normally closed set of contacts 33 initially connected in series with the start switch through the clockwise start winding 34 of drive motor 23.

Upon throwing of the top limit directional switch 20, switch 33 provides for energization of timer motor 22 from the now closed switch 31 and drawer tilt switch 32 to accumulate an incremental time in the timer 19. When the ram reaches the bottom of its stroke, a motor centrifugal switch 35 connects a counterclockwise start winding 36 of the drive motor from switch 33 through the motor protector 30 to power supply lead L2 to effect a reversal of the ram movement. When the ram reaches the top of its stroke, switch 20 is restored to the arrangement of FIG. 2 for a further compacting cycle as described above.

Thus, the invention comprehends the provision of means for providing an indication to the user of the need for replenishment of the refuse-treating material supply as a function of time accumulated in a timer from incremental running thereof during each cyclical compaction operation of the apparatus.

The provision of the replacement-need signal permits the user to efficiently utilize the refuse compactor deodorizing and sanitizing means and effectively avoids the undesirable compactor conditions rsulting from a failure to recognize the need for such replacement.

In one embodiment of the invention, the timer was set to provide illumination of lamp 25 upon the accumulation of a total time corresponding to 60 days of normal operation of the compactor.

As the operation of the indicating means is a function of the number of cycles of the compacting ram, any suitable material-treating means may be utilized as desired, with the accumulated time of the timer being correlated with the useful life of the material supply by suitable selection or setting of the timer.

The method and apparatus of the invention are extremely simple while yet providing the highly desirable improved replenishment need indication as discussed above.

The foregoing disclosure of specific embodiments is illustrative of the broad inventive concepts comprehended by the invention.

I claim:

1. A method of indicating the need for replenishing a supply of trash-treating material sequentially delivered into a trash compactor trash receiver, comprising the steps of:

causing a timer to advance seriatim a preselected amount as a result of each compacting operation of a compacting ram of the trash compactor; and causing an indication of the need to replenish said supply as the result of a preselected cumulative advance of said timer.

2. The method of indicating the need for replenishing a supply of trash-treating material of claim 1 wherein said step of providing an indication of the need to replenish said supply comprises a step of providing a visual indication thereof.

3. The method of indicating the need for replenishing a supply of trash-treating material of claim 1 wherein said step of providing an indication of the need to replenish said supply comprises a step of illuminating a signal lamp.

4. A method of effectively indicating the causing of a preselected number of discrete sprays from a container of pressurized spray material removably installable in a trash compactor comprising the steps of:

causing a spray of spray material from the container substantially each time refuse is deposited in the trash compactor;

causing a timer to advance seriatim a preselected amount as a result of each operation of the trash compactor; and providing an indication of a preselected cumulative advance of said timer corresponding to a preselected number of sprays from the container.

5. The method of effectively indicating the causing of a preseleted number of discrete sprays from a container of pressurized spray material of claim 4 wherein said step of providing a timer comprises a step of providing a visual indication thereof.

6. The method of effectively indicating the causing of a preselected number of discrete sprays from a container of pressurized spray material of claim 4 wherein said step of providing a timer comprises a step of illuminating a signal lamp.

7. In a trash compactor having a ram, a compaction receptacle, and means for operating the ram seriatim to compact trash deposited in said receptacle, the improvement comprising:

a timer;

means for causing the timer to advance seriatim a preselected amount as a result of each compacting operation of the trash compactor ram;

a container of spray material mounted adjacent said receptacle;

means for causing a spray of spray material from the container into the receptacle during each said operation of the trash compactor ram; and means for providing an indication of a preselected cumulative advance of said timer.

8. The trash compactor structure of claim 7 wherein said means for providing an indication comprises means for providing a visual indication.

9. The trash compactor structure of claim 7 wherein said means for providing an indication comprises a signal lamp.

10. The trash compactor structure of claim 7 wherein said means for advancing the timer comprises a top limit directional switch.

11. In a refuse compactor having means for delivering a quantity of refuse-treating material from a supply thereof onto refuse deposited in the compactor, and means for effecting compaction of the deposited refuse in the compactor, the improvement comprising:

a signal device associated with the compactor;

timer means for actuating said signal device as the result of said timer means being run for a preselected period of time; and means for incrementally running the timer each time a compaction of the deposited refuse is effected to cause operation of the signal device when the cumulative time of running of the timer reaches said preselected period of time.

12. The refuse compactor structure of claim 11 further including means for resetting the timer means concurrently with replenishment of the refuse-treating material supply.

13. The refuse compactor structure of claim 11 wherein said period of time is preselected as a function of the useful life of said refuse-treating material supply.

14. The refuse compactor structure of claim 11 further including switch means for controlling the running of the timer means, and means for operating the switch means once during each compaction operation.

* * * * *